US006542136B1

(12) United States Patent
Smith

(10) Patent No.: US 6,542,136 B1
(45) Date of Patent: Apr. 1, 2003

(54) MEANS FOR REDUCING CROSSTALK IN A FIELD EMISSION DISPLAY AND STRUCTURE THEREFOR

(75) Inventor: Robert T. Smith, Tempe, AZ (US)

(73) Assignee: Motorola, Inc., Schaumburg, IL (US)

( * ) Notice: Subject to any disclaimer, the term of this patent is extended or adjusted under 35 U.S.C. 154(b) by 296 days.

(21) Appl. No.: 09/657,955

(22) Filed: Sep. 8, 2000

(65) Prior Publication Data

(65)

(51) Int. Cl.[7] ..... G09G 3/20
(52) U.S. Cl. ..... 345/75.2; 345/74.1; 315/169.3
(58) Field of Search ..... 345/75.1, 75.2, 345/76, 74.1, 73, 77, 690, 691; 315/169.1, 169.3, 169.4

(56) References Cited

U.S. PATENT DOCUMENTS 5,075,683 A 12/1991 Ghis ..... 340/793
5,138,308 A 8/1992 Clerc et al. ..... 340/758
5,404,074 A * 4/1995 Watanabe et al. ..... 345/75.2
5,587,720 A * 12/1996 Fukuta et al. ..... 345/75.2
5,703,611 A 12/1997 Kishino et al.
5,742,267 A 4/1998 Wilkinson ..... 345/77
6,031,344 A 2/2000 Foo et al. ..... 315/307
6,060,840 A 5/2000 Foo et al. ..... 315/169.1
6,069,597 A 5/2000 Hansen ..... 345/74

FOREIGN PATENT DOCUMENTS

EP 0905670 3/1999

* cited by examiner

*Primary Examiner*—Xiao Wu
(74) *Attorney, Agent, or Firm*—William E. Koch; Kevin D. Wills

(57) ABSTRACT

Method and structure for reducing crosstalk between adjacent column conductors in a field emission display (50) that has a plurality of column conductors (57, 59) on which electron emission structures (64) are disposed. The field emission display (50) also includes a plurality of row conductors (67, 68). A field termination structure (58) is formed between adjacent column conductors. The field termination structure (58) attenuates a voltage glitch created by a switching column conductor, thereby preventing the voltage glitch from affecting adjacent nonswitching column conductors.

18 Claims, 3 Drawing Sheets

-PRIOR ART-

MEANS FOR REDUCING CROSSTALK IN A FIELD EMISSION DISPLAY AND STRUCTURE THEREFOR

CROSS REFERENCE TO RELATED APPLICATIONS

The present invention is related to the U.S. patent application Ser. No. 09/658,514 entitled "FIELD EMISSION DISPLAY AND METHOD," to Robert T. Smith, which application is incorporated herein by reference.

FIELD OF THE INVENTION

The present invention relates, in general, to field emission displays and, more particularly, to methods and circuits for controlling emission current in the field emission displays.

BACKGROUND OF THE INVENTION

Field emission displays (FED's) are well known in the art. A field emission display includes an anode plate and a cathode plate that define a thin envelope. The cathode plate includes a matrix of column conductors and row conductors, which are used to cause electron emission from electron emitter structures such as, Spindt tips. FED's further include ballast resistors between the electron emitter structures and the cathode plate for controlling the electron emission current. In addition to the desired FED components, a parasitic fringe capacitance is formed between adjacent column conductors. These parasitic fringe capacitances allow crosstalk between adjacent column conductors when one of the column conductors switches from a high impedance state to a high voltage state. The crosstalk may result in a glitch on the column conductor that remains in the high impedance state where the glitch introduces error that appears in the picture appearing on the field emission display.

Accordingly, there exists a need for a method and means for controlling the adjacent column capacitance in a field emission display, which overcome at least some of these shortcomings.

BRIEF DESCRIPTION OF THE DRAWINGS

For simplicity and clarity of illustration, elements in the drawings are not necessarily drawn to scale, and the same reference numerals in different figures denote the same elements.

DETAILED DESCRIPTION OF THE DRAWINGS

Generally, the present invention is for a method and a field emission display for reducing crosstalk between adjacent columns in a Field Emission Display (FED). The method includes terminating fringing fields between adjacent column conductors such that switching column conductors do not interfere with non-switching column conductors.

Figure 1:
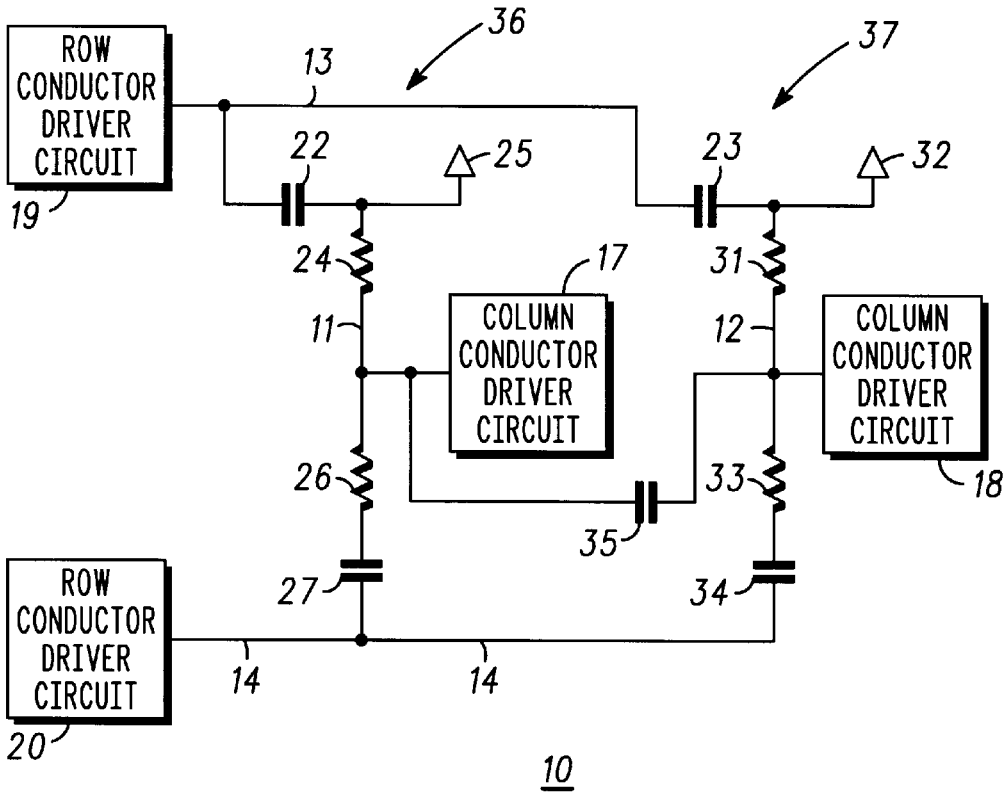
FIG. 1 is a circuit representation of a prior art field emission display.

FIG. 1 is a circuit representation of a prior art field emission display 10. What is shown in FIG. 1 is a row conductor driver circuit 19 coupled to each column conductor 11 and 12 via a row conductor 13 and sub-pixel capacitances 22 and 23, respectively. Sub-pixel capacitance 22 is connected to the output terminal of a column conductor driver circuit 17 via a ballast resistor 24 and to electron emission structure 25. The output of column conductor driver circuit 17 is also coupled to row conductor 14 via an equivalent ballast resistor 26 and an equivalent capacitance 27. A row conductor driver circuit 20 is connected to row conductor 14.

Sub-pixel capacitance 23 is connected to the output terminal of a column conductor driver circuit 18 via a ballast resistor 31 and to electron emission structure 32. The output of column conductor driver circuit 18 is also coupled to row conductor 14 via an equivalent ballast resistor 33 and an equivalent capacitance 34.

Although only two row conductors and two column conductors are shown in FIG. 1, it should be understood that in a typical FED there are typically many more than two row conductors and two column conductors. To facilitate describing the present invention, it is assumed there are n rows of row conductors, where n is an integer. Resistors 26 and 33 represent a lumped circuit model representing (n−1) ballast resistors and capacitances 27 and 34 represent (n−1) sub-pixel capacitances. Likewise, electron emission structure 25 represents the electron emission structures associated with column conductor 11 and row conductor 13 and electron emission structure 32 represents the electron emission structures associated with column conductor 12 and row conductor 13. Row conductor 14 represents (n−1) row conductors of field emission display 10 where row conductor 13 represents a single row conductor of field emission display 10. Thus, capacitances 27 and 34 represent an effective capacitance and resistors 26 and 33 represent an effective ballast resistance. The values of the effective capacitances and effective resistances are given by:

$$C_{27}=(n-1)*C_{22}$$

$$R_{26}=1/(n-1)*R_{24}$$

where $C_{27}$ represents the lumped capacitance associated with the (n−1) row conductors coupled to column conductor 11 that are not activated;

$C_{22}$ represents the capacitance associated with a single activated row conductor coupled to column conductor 11;

$R_{26}$ represents the lumped ballast resistance associated with the (n−1) row conductors coupled to column conductor 11 that are not activated;

$R_{24}$ represents the ballast resistance associated with a single activated row conductor coupled to column conductor 11; and n is the number of row conductors of the FED.

It should be understood that each column conductor has a similar effective capacitance and effective ballast resistance associated therewith. For example, the effective capacitance and effective ballast resistance associated with column conductor 12 when all but row conductor 13 is not activated is given by:

$$C_{34}=(n-1)*C_{23}$$

$$R_{33}=1/(n-1)*R_{31}$$

where $C_{34}$ represents the lumped capacitance associated with the (n−1) row conductors coupled to column conductor 12 that are not activated;

$C_{23}$ represents the capacitance associated with a single activated row conductor coupled to column conductor 12;

$R_{33}$ represents the lumped ballast resistance associated with the (n−1) row conductors coupled to column conductor 12 that are not activated;

$R_{31}$ represents the ballast resistance associated with a single activated row conductor coupled to column conductor 12; and n is the number of row conductors of the FED.

Column conductor 11 is coupled to column conductor 12 via a parasitic fringe capacitance 35. Capacitance 35 couples cross-talk between a column conductor that is switching from being in a high impedance state to one at a high voltage. For example if sub-pixels 36 and 37 are both "on," i.e., emitting current, then column driver circuits 17 and 18 are in a high impedance state and row conductor driver circuit 19 is in a high output state. Capacitances 27 and 34 are charging at rates defined by the currents being emitted by the respective sub-pixels 36 and 37. When sub-pixel 36 has emitted a sufficient charge, column conductor driver circuit 17 switches to a high voltage, $V_{COL}$, thereby turning off sub-pixel 36. If sub-pixel 37 has not yet emitted enough charge, column conductor driver circuit 18 remains in a high impedance state. However, a voltage glitch may be produced on column conductor 12 by the switching of column conductor driver circuit 17.

The amplitude of the voltage glitch, $V_{GLI}$, is approximated by:

$$V_{GLI} \approx V_{COL} * C_{35}/C_{34}$$

where $V_{COL}$ is the column switching voltage;

$C_{35}$ is the capacitance value of capacitance 35; and $C_{34}$ is the capacitance value of capacitance 34.

If the glitch is too large, it will degrade the quality of the display of FED 10.

Figure 2:
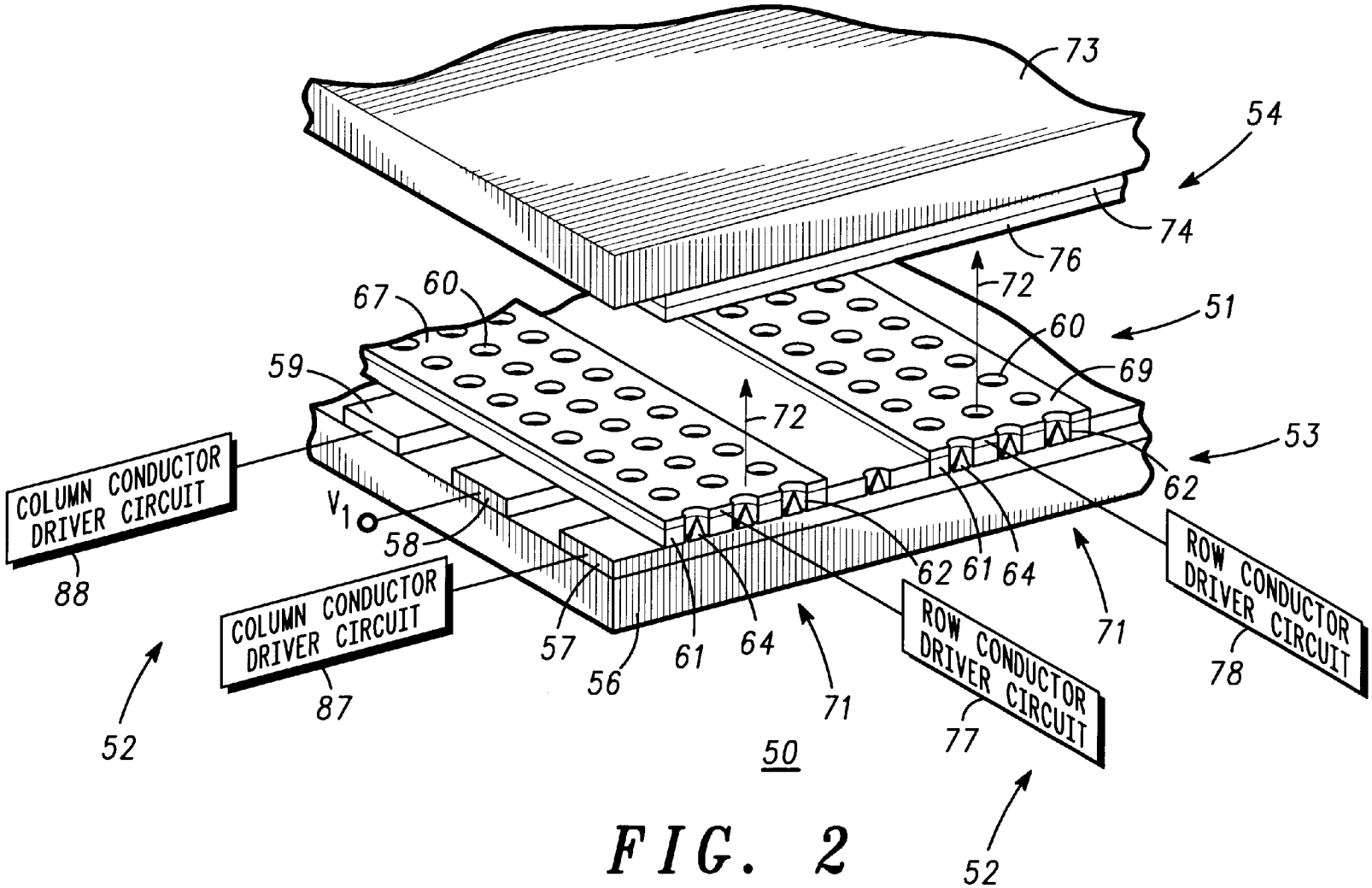
FIG. 2 is a partially cut-away isometric view and circuit schematic representation of a field emission display (FED) in accordance with an embodiment of the present invention.

FIG. 2 is a partially cut-away isometric view and circuit schematic representation of a field emission display (FED) 50 in accordance with an embodiment of the present invention. FED 50 includes an FED device 51 and control circuitry 52 for controlling emission current.

FED device 51 includes a cathode plate 53 and an anode plate 54. Cathode plate 53 includes a substrate 56, which can be made from glass, silicon, and the like. A first column conductor 57 and a second column conductor 59 are disposed on substrate 56. A field termination structure 58 is disposed on substrate 56, wherein field termination structure 58 is between and spaced apart from column conductors 57 and 59. A dielectric layer 61 is disposed upon column conductors 57 and 59 and on termination structure 58. Dielectric layer 61 further defines a plurality of wells 62.

An electron emitter structure 64 such as, for example, a Spindt tip, is disposed in each of wells 62. Row conductors 67 and 69 are formed on dielectric layer 61. Row conductors 67 and 69 are spaced apart from and proximate to electron emitter structures 64. Row conductors 67 and 69 include a plurality of apertures 60 which cooperate with corresponding wells 62 and electron emitter structures 64 to form current emission regions 71. Column conductors 57 and 59 and row conductors 67 and 69 are used to selectively address electron emitter structures 64.

To facilitate understanding, FIG. 2 depicts only two column and row conductors in a single field termination structure. However, it is desired to be understood that any number of column and row conductors can be employed. However, a column termination structure is preferably formed between each set of adjacent column conductors. An exemplary number of row conductors for an FED device is 240 and an exemplary number of column conductors is 960. Methods for fabricating cathode plates for matrix-addressable field emission displays are known to one of ordinary skill in the art.

Anode plate 54 is disposed to receive an emission current 72, which is defined by the electrons emitted by electron emitter structures 64. Anode plate 54 includes a transparent substrate 73 made from, for example, glass. An anode 74 is disposed on transparent substrate 73. Anode 74 is preferably made from a transparent conductive material, such as indium tin oxide. In the preferred embodiment, anode 74 is a continuous layer that opposes the entire emissive area of cathode plate 53. That is, anode 74 preferably opposes the entirety of electron emitter structures 64.

A plurality of phosphors 76 is disposed upon anode 74. Phosphors 76 are cathodoluminescent. Thus, phosphors 76 emit light upon activation by emission current 72. Methods for fabricating anode plates for matrix-addressable field emission displays are known to one of ordinary skill in the art.

In accordance with one embodiment of the present invention, control circuitry 52 comprises row conductor driver circuits 77 and 78 and column conductor driver circuits 87 and 88. Row conductor driver circuits 77 and 78 are coupled to row conductors 67 and 69, respectively, and column conductor driver circuits 87 and 88 are coupled to column conductors 57 and 59, respectively.

Termination structure 58 is coupled for receiving a voltage $V_1$. Preferably, voltage $V_1$ is zero volts or ground potential.

Figure 3:
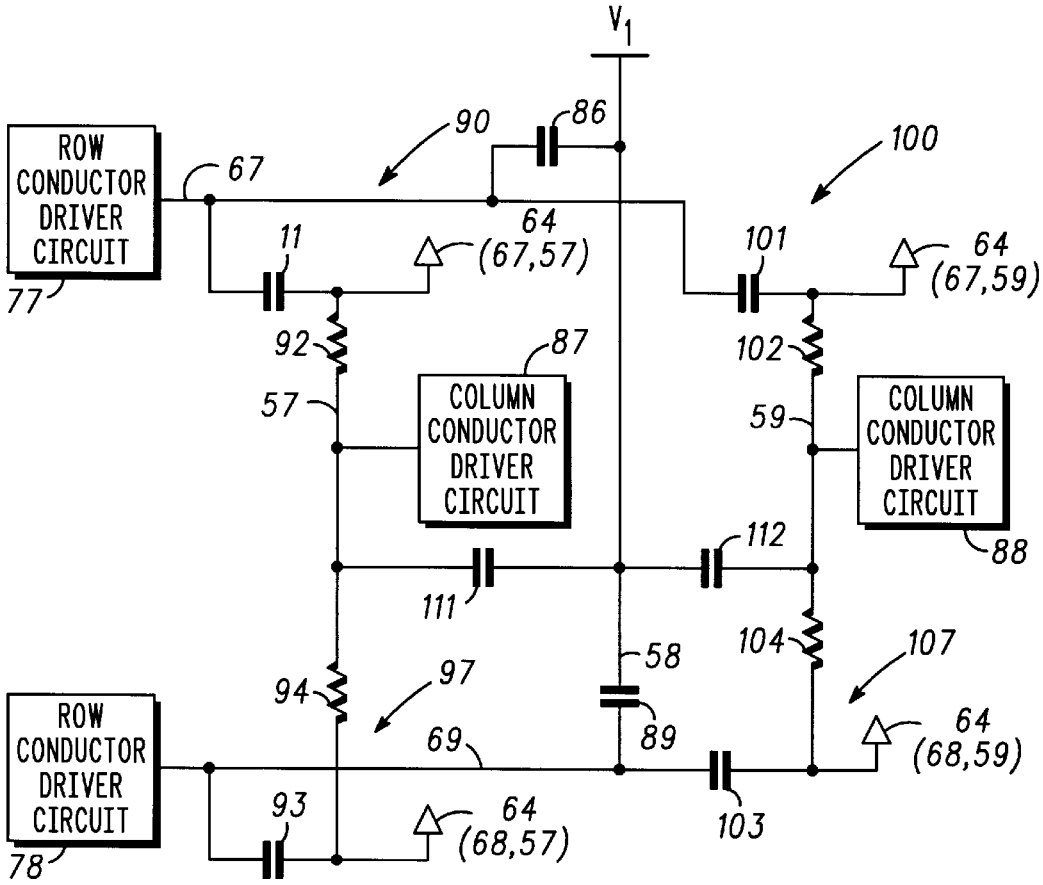
FIG. 3 is circuit representation of a field emission display in accordance with an embodiment of the present invention.

FIG. 3 is a schematic diagram of cathode plate 53 of FED 50. What is shown in FIG. 3 is a schematic representation of column conductors 57 and 59, column conductor driver circuits 87 and 88, row conductors 67 and 69, and row conductor driver circuits 77 and 78. It should be understood that although only two row conductor driver circuits and two column conductor driver circuits are shown, wherein each row conductor is driven by a row conductor driver circuit and each column conductor is driven by a column conductor driver circuit, this is not a limitation of the present invention.

Between column conductors 57 and 59 is field termination structure 58, which is comprised of inherent capacitances 86 and 89, where capacitance 86 is coupled between a voltage source $V_1$ and row conductor 67 and capacitance 89 is coupled between voltage source $V_1$ and row conductor 69. Preferably voltage $V_1$ operates at ground potential.

FIG. 3 further illustrates electron emission structures, sub-pixel capacitances, and ballast resistors associated with each row and column conductor of FED 50. More particularly, sub-pixel capacitance 91, sub-pixel ballast resistor 92, and electron emission structure $\mathbf{64}_{(67,57)}$ associated with sub-pixel 90 are shown as being coupled to row conductor 67 and column conductor 57. Electron emission structure $\mathbf{64}_{(67,57)}$ is shown as a lumped model element representing all the electron emission structures associated with sub-pixel 90.

Sub-pixel capacitance 93, sub-pixel ballast resistor 94, and electron emission structure $\mathbf{64}_{(68,57)}$ associated with sub-pixel 97 are shown as being coupled to row conductor 68 and column conductor 57. Electron emission structure $\mathbf{64}_{(68,57)}$ is shown as a lumped model element representing all the electron emission structures associated with sub-pixel 97.

Sub-pixel capacitance 101, sub-pixel ballast resistor 102, and electron emission structure $\mathbf{64}_{(67,59)}$ associated with sub-pixel 100 are shown as being coupled to row conductor 67 and column conductor 59. Electron emission structure $\mathbf{64}_{(67,59)}$ is shown as a lumped model element representing all the electron emission structures associated with sub-pixel 100.

Sub-pixel capacitance 103, sub-pixel ballast resistor 104, and electron emission structure $\mathbf{64}_{(68,59)}$ associated with sub-pixel 107 are shown as being coupled to row conductor 68 and column conductor 59. Electron emission structure $\mathbf{64}_{(68,59)}$ is shown as a lumped model element representing all the electron emission structures associated with sub-pixel 107.

Column conductor 57 is coupled to field termination structure 58 by a parasitic capacitance 111. Likewise, column conductor 59 is coupled to field termination structure 58 by a parasitic capacitance 112.

In operation, assume row conductor driver circuit 77 outputs a high voltage, e.g., 80 volts, and row conductor driver circuit 78 outputs a low voltage, e.g., 0 volts, thereby allowing activation of sub-pixels 90 and 100, and further assume adjacent column conductors are in a non-switching state. When column conductor driver circuit 87 changes from a high impedance state to an "off" or a high voltage state and column conductor driver circuit 88 does not change state, a voltage glitch is not created by switching column conductor 87 because the column to column capacitance is negligibly small because of the presence of field termination structure 58.

By now it should be appreciated that a structure and a method have been provided for reducing cross-talk between adjacent column conductors in a field emission display. The structure includes a field termination structure between adjacent column conductors that that terminates the electric field generated from a switching column conductor.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

What is claimed is:

1. A method for reducing cross-talk between column conductors of a field emission display, the field emission display having first and second column conductors on which electron emitter structures are disposed and a plurality of row conductors having apertures formed therein, wherein the plurality of column conductors and the plurality of row conductors cooperate to form sub-pixels, comprising:

forming a field termination structure between and spaced apart from the first and second column conductors;

causing a portion of the electron emitter structures disposed on the first and second column conductors to emit electrons, thereby defining an emission current; and terminating an electric field created when the electron emitter structures associated with the first column conductor switch from a first operating state to a second operating state, wherein the electric field is terminated at the field termination structure formed between and spaced apart from the first and second column conductors.

2. The method of claim 1, wherein causing a portion of the electron emitter structures to emit electrons comprises applying a row select voltage to a row conductor of the plurality of row conductors.

3. The method of claim 1, wherein causing a portion of the electron emitter structures to emit electrons comprises applying a column select voltage to a column conductor of the plurality of column conductors.

4. The method of claim 1 further including coupling a column conductor driver circuit to a column conductor of the plurality of column conductors, the column conductor driver circuit including a tri-state driver.

5. The method of claim 1, wherein the step of forming a field termination structure includes forming a terminating electrode between and spaced apart from the first and second column conductors.

6. The method of claim 5, further including coupling the terminating electrode to a first reference voltage.

7. The method of claim 6, wherein the first reference voltage is a ground potential.

8. A method for reducing crosstalk in a field emission display, the field emission display having first and second column conductors spaced apart from each other, at least one row conductor, and electron emitter structures disposed on the first and second column conductors, the method comprising:

causing the plurality of electron emitter structures disposed on the first and second column conductors to emit electrons, thereby defining an emission current; and turning off the omission current from the first column conductor, wherein a switching field is generated when the emission current of the first column conductor is turned off; and forming an electrically conductive structure between the first and second column conductors and coupled to a first reference voltage, thereby preventing the switching field from altering the emission current from the second column conductor when the emission current from the first column conductor is turned off.

9. The method of claim 8, wherein the first reference voltage is a ground potential.

10. The method of claim 8, further including coupling an amplitude modulation circuit to the first column conductor.

11. The method of claim 10, further including coupling a pulse width modulation circuit to the first column conductor.

12. A field emission display having an improved immunity to crosstalk, comprising:

a first conductor;

a first conductor driver circuit coupled to the first conductor;

a second conductor, the second conductor spaced apart from the first conductor and coupled to the first conductor via a first capacitance;

a second conductor driver circuit coupled to the second conductor;

a field termination structure between and spaced apart from the first and second conductors;

a third conductor, the third conductor coupled to the first and second conductors via a second and third capacitances;

a third conductor driver circuit coupled to the third conductor; and a plurality of electron emission structures disposed on the first conductor.

13. The field emission display of claim 12, wherein the first conductor driver circuit is capable of operating in a high impedance state.

14. The field emission display of claim 12, wherein the first conductor driving circuit includes a sub-circuit for providing amplitude modulation.

15. The field emission display of claim 14, wherein the first conductor driving circuit further includes a sub-circuit for providing pulse width modulation.

16. The field emission display of claim 12, wherein the first conductor driving circuit includes a sub-circuit for providing pulse width modulation.

17. The field emission display of claim 12, wherein the field termination structure is coupled from receiving a substantially constant voltage.

18. The field emission display of claim 17, wherein the substantially constant voltage is a ground voltage.

* * * * *